United States Patent [19]

DuRocher

[11] 3,974,470

[45] Aug. 10, 1976

[54] MULTI-STAGE SWITCHING APPARATUS

[75] Inventor: Gideon A. DuRocher, Mount Clemens, Mich.

[73] Assignee: Essex International, Inc., Fort Wayne, Ind.

[22] Filed: Aug. 1, 1975

[21] Appl. No.: 601,217

Related U.S. Application Data

[62] Division of Ser. No. 517,490, Oct. 24, 1974, Pat. No. 3,918,020.

[52] U.S. Cl. ..... 338/114; 338/99; 338/100

[51] Int. Cl.[2] ..... H01C 13/00

[58] Field of Search ..... 338/114, 99, 100, 101, 338/108, 110, 111, 223–225, 260; 200/153 R, 153 C, 85

[56] References Cited

UNITED STATES PATENTS 2,596,420 5/1952 McGarvey ..... 338/100 X 3,386,067 5/1968 Costanzo ..... 338/114 X

*Primary Examiner*—C. L. Albritton

[57] ABSTRACT

A multi-stage switching apparatus adapted to make and break an electrical circuit comprises a first compressible body having a resistance which varies inversely according to its state of compression and a second compressible body having a substantially uniform resistance lower than that of the first body, the two bodies being so arranged that the first body is compressed prior to compression of the second body in response to making of the circuit and is decompressed following decompression of the first body in response to breaking of the circuit.

10 Claims, 9 Drawing Figures

MULTI-STAGE SWITCHING APPARATUS

RELATED APPLICATION

This application is a division of application Ser. No. 517,490, filed Oct. 24, 1974, now U.S. Pat. No. 3,918,020.

This invention relates to electrical switching apparatus and more particularly to a switch having at least two compressible, electrically conductive members which are compressible and decompressible sequentially. The first member to be compressed has a electrical resistance which varies inversely according to its state of compression, whereas the second body has a substantially uniform resistance which is less than that of the first body. Sequential compression of the two members, therefore, establishes a first electrically conductive path through the first body of diminishing resistance, followed by the establishment of a second electrically conductive path through the second member and bypassing of the first member. Upon decompression of the members, the electrical path through the lower resistance member is broken first and an electrical path of increasing resistance is reestablished through the variable resistance member.

In a resistive circuit such as that having incandescent lamps controlled by a switch, closing of the switch to complete a circuit to the lamps results in a momentary high inrush current of extremely high peak value. In a circuit of the kind having an inductive load controlled by a switch, opening of the switch results in a momentary, extremely high voltage peak. These characteristics of resistive and inductive circuits are objectionable for many well-known reasons. Although these objectionable charateristics can be minimized by the utilization of rheostatic switches, such switches have disadvantages. For example, the resistance of a rheostatic switch depends upon a particular setting thereof. Unless considerable care is exercised to assure precise setting of the switch in its operating mode, then the resistance of the circuit may be either too little or too great. Another disadvantage of rheostatic switches is that they generate substantial heat in operation. Provision must be made to dissipate such heat, and the problems associated with heat dissipation are magnified in those instances in which precise adjustment of the switch is not assured.

An object of this invention is to provide switching apparatus which is highly effective in suppressing current and voltage peaks attendant the making and breaking of resistive and inductive circuits, respectively.

Another object in the invention is to provide switching apparatus of the character described and which comprises at least a pair of conductive members, one of which has variable resistance characteristics and the other of which has substantially constant resistance characteristics, the two members being so arranged that the variable resistance member is the first to become electrically conductive and the last to become non-conductive.

A further object of the invention is to provide a multi-stage switching apparatus which has the advantages of a rheostatic switch, but none of its disadvantages.

Other objects and advantages of the invention will be pointed out specifically or will become apparent from the following description when it is considered in conjunction with the appended claims and the accompanying drawings, in which:

Figure 1:
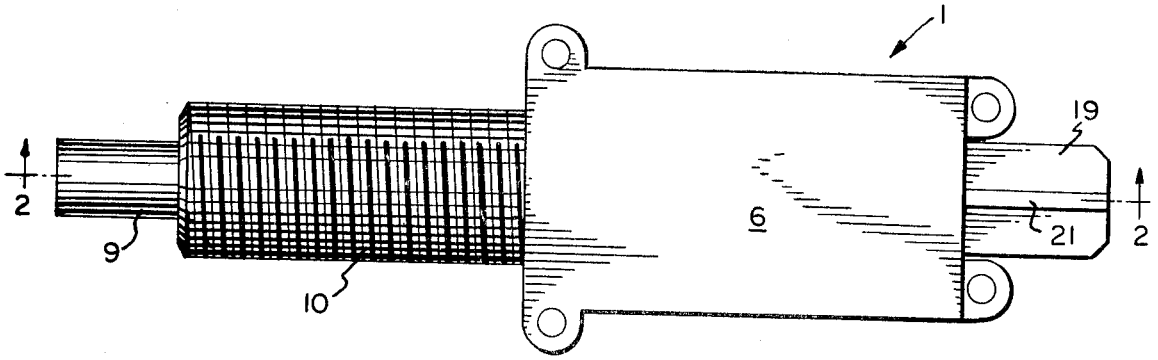
FIG. 1 is a plan view of a switch incorporating apparatus constructed in accordance with one embodiment of the invention.

Apparatus constructed in accordance with the embodiment of the invention shown in FIGS. 1 – 7 comprises a switch casing 1 having a base 2, a pair of upstanding, spaced apart side walls 3, and front and rear walls 4 and 5, respectively. The casing also includes a cover 6 fixed to the side, front, and rear walls in any suitable manner. Slidably accommodated within the casing 1 is an actuator 7 having a blind bore 8 extending inwardly from its rearward end. At the forward end of the actuator 7 is an elongate operating stem 9 that extends through a tubular guide 10 which projects forwardly from the front wall 4 of the casing. Fitted into the bore 8 is a compression spring 11, one end of which seats on the base of the bore and the opposite end of which bears against an abutment 12 that is fixed to the bottom wall 2 of the casing. The spring 11 normally biases the actuator to the position shown in FIG. 2 in which it abuts the front wall 4 of the casing and in which position the free end of the operating stem 9 extends beyond the guide 10.

Within the casing 1 is a pair of electrical conductors 13 and 14 the forward ends of which are fitted into notches 15 and 16, respectively, formed in the front wall 4 of the casing. The rear ends of the conductors 13 and 14 extend through openings formed in the rear wall 5 of the casing to form terminals 18 and 19 which are provided with reinforcing ribs 20 and 21, respectively. The terminal 18 may be connected to a source of energy, such as a battery B, and the terminal 19 may be connected to a load L.

The conductor 14 bears against the top wall 6 of the casing to prevent upward deflection of the conductor. The conductor 13 has a section 22 thereof which is spaced below the conductor 14 and terminates at its rearward end in a downwardly turned leg 23 which is joined to the terminal 18 so as to provide spacing between the terminals 18 and 19 and permit reciprocation of the actuator 7 without unwanted interference with the conductor 13.

The section 22 of the conductor 13 is provided along its opposite edges with a pair of downwardly extending, V-shaped projections 24 which lie in the path of movement of cams 25 carried by the body 7 at that side of the latter which confronts the conductor section 22.

The forward ends of the cams 25 terminate in upwardly and rearwardly inclined surfaces 26.

At substantially the center of the conductor 14 is a pair of downwardly struck mounting ears 27, 28 by means of which a switching member 30 is supported on the conductor 14 and between the latter and the conductor 13.

The switching member 30 comprises two resiliently compressible bodies 31 and 32, the body 31 being annular in configuration and having a peripheral flange 33. The body 32 is disc-like and has a peripheral flange 34. The body 31 encircles the body 32 and is thicker than the latter for a purpose presently to be explained. The body 32 may be retained frictionally within the body 31 or it may be bonded to the latter.

The switching member 30 is secured to the conductor 14 by fitting the flange 33 of the body 31 between the ears 27, 28 and the main body portion of the conductor 14. Alternatively, the ears 27, 28 may be dispensed with and the switching member 30 secured to the conductor 14 by any one of a number of known conductive cements.

Figure 2:
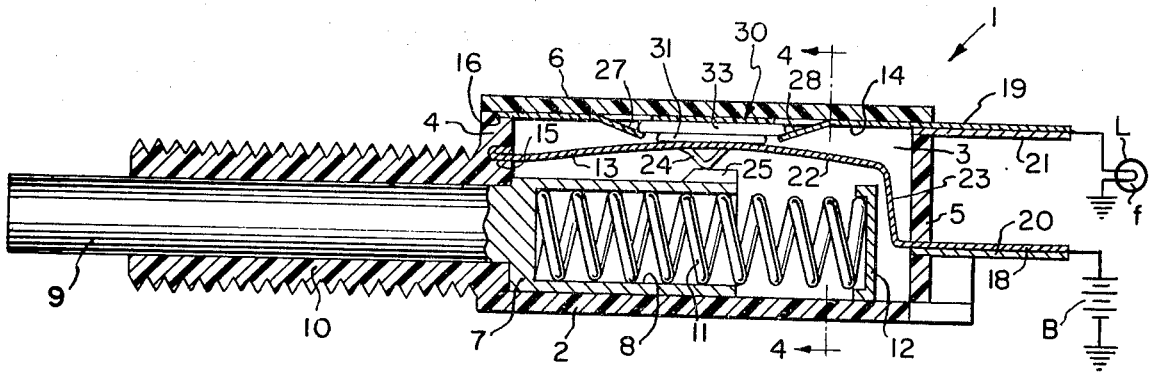
FIG. 2 is a sectional view taken on the line 2—2 of FIG. 1 and illustrating the parts in circuit closing condition.
Figure 3:
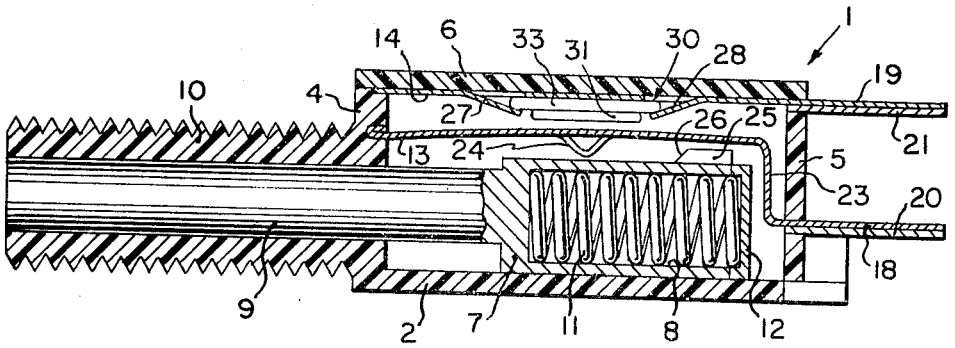
FIG. 3 is a view similar to FIG. 2, but illustrating the parts in open-circuit condition.
Figure 4:
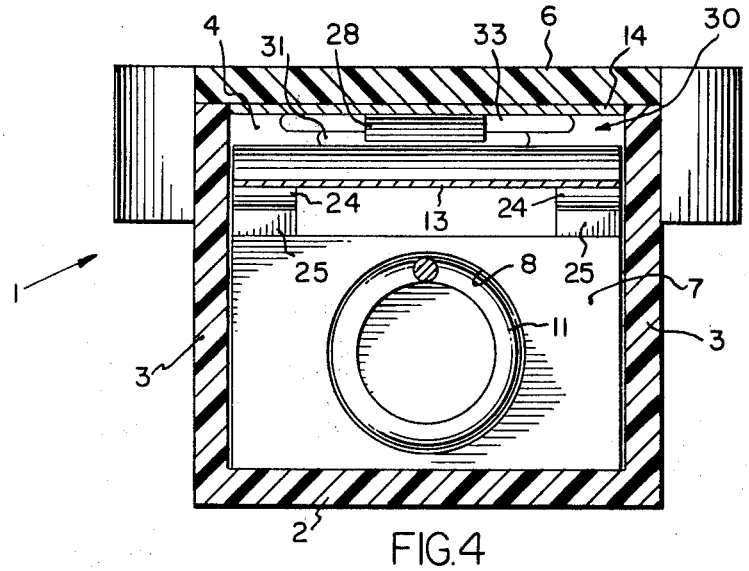
FIG. 4 is a sectional view taken on the line 4—4 of FIG. 2.
Figure 5:
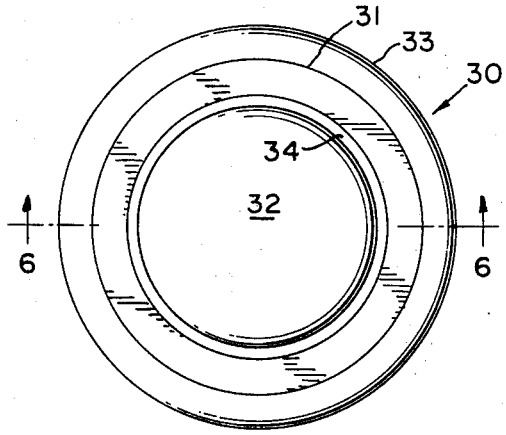
FIG. 5 is a plan view of the switching member illustrated in FIGS. 2 and 3.
Figure 6:
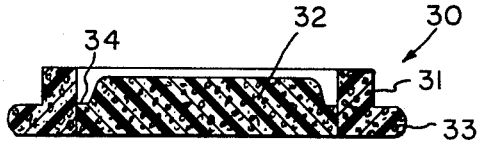
FIG. 6 is a sectional view taken on the line 6—6 of FIG. 5.
Figure 7:
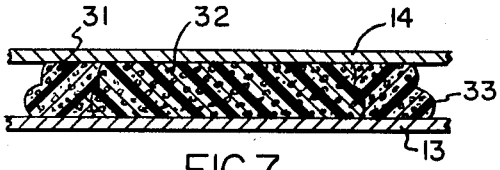
FIG. 7 is a view similar to FIG. 6, but illustrating the switching member interposed between a pair of conductors and subjected to compressive force.

In the operation of the apparatus thus far described, movement of the actuator 7 by means of the operating stem 9 from the position shown in FIG. 2 to the position shown in FIG. 3 moves the cams 25 out of engagement with the projections 24 so as to enable the section 22 of the conductor 13 to assume a substantially horizontal position in which the conductor 13 is out of engagement with the switching member 30. Upon return movement of the actuator to the position shown in FIG. 2, however, the cams 25 will engage the projections 24 and deflect the section 22 of the conductor 13 upwardly or toward the conductor 14. As the conductor 13 is deflected upwardly, it will engage the body 31 and compress the latter. When the body 31 has been compressed an amount corresponding to the difference in thickness between the bodies 31 and 32, further deflection of the conductor 13 toward the conductor 14 will effect compression of both of the bodies 31 and 32, as is shown in FIG. 7. Compression of the body 31, therefore, precedes compression of the body 32.

Upon movement of the actuator 7 from the position shown in FIG. 2 to the position shown in FIG. 3, the projections 24 will slide down the inclined surfaces 26 of the cams 25 so as to enable the section 22 of the conductor 23 to move away from the conductor 14. During such movement of the section 22, both of the bodies 31 and 32 will be decompressed. Eventually, the body 32 will be fully decompressed, and full decompression of the body 32 precedes full decompression of the body 31.

When the switching member 30 is utilized in the manner described, the annular body 31 is the first to be compressed and the last to be decompressed. Accordingly, the body 31 should be so constructed as to have an electrical resistance which varies inversely according to the state of its compression. Preferably, the body 31 comprises a molded member of resiliently compressible, non-conductive material, such as silicone rubber, containing a quantity of electrically resistive, conductive particles of such size as to accommodate the currents and heat to be encountered in normal usage. The body 31 may be molded from either a thermosetting or room temperature vulcanization silicone resin containing the appropriate catalyst and a quantity of fine particulate material such as carbon, tungsten, nickel-chromium, and the like. Excellent results have been obtained when a body 31 intended for use with a 14 volt, d.c. battery contained A.M.I. nichrome of 140 – 200 mesh size and in a weight ratio of about seven parts nichrome to one part of silicone rubber. Although the body 31 may be normally conductive even when it is not subjected to compressive force, the resistance of the body 31 preferably approaches infinity in its normal, uncompressed state, and diminishes generally linearly as the body is compressed.

The body 32 also comprises a molded member of resiliently compressible, non-conductive material, such as silicone rubber, throughout which is dispersed a quantity of electrically conductive particles of a size appropriate to the voltage and current of the circuit in which it is to be used. As compared to the particles contained in the body 31, the particles contained in the body 32 are of considerably less resistance. Stated differently, the body 32 is considerably more conductive than the body 31. This relationship can be obtained by utilizing silver or silver-coated copper particles in the body 32. Excellent results have been obtained with a body 32 for use with the aforementioned d.c. battery and containing silver-coated copper particles of 25 – 50 mesh size in a weight ratio of about ten parts of particles to one part of silicon rubber.

If desired, the body 32 may be molded under pressure so as to be conductive even in the absence of the application of compressive force thereto. Alternatively, the body 32 may be molded at atmospheric pressure so as to be non-conductive until compressed. In either event, the electrical resistance of the body 32, when conductive, corresponds substantially to the resistance of silver and is substantially less than the resistance of the body 31 when the latter is in its compressed state and conductive.

It is desirable that both of the bodies 31 and 32 be compressible. Such a construction makes it possible for the member 30 to accommodate overtravel of the conductor 13 toward the conductor 14, thereby assuring sufficient movement of the conductor 13 to ensure compression of the body 32 without risking damage to the other parts of the switch mechanism.

It also is desirable that the body 31 be more easily compressible than the body 32 so as to avoid the necessity of having to use excessive force in the operation of the switching member 30. Excellent results may be obtained if the body 31 has a durometer rating of about half that of the body 32.

When the switching member 30 is interposed between the conductors 13 and 14 and the actuator 7 moves from the position shown in FIG. 3 toward the position shown in FIG. 2, deflection of the conductor section 22 toward the conductor 14 will cause the body 31 to be subjected to compression, thereby enabling current to flow from the battery B through the terminal 20 to the conductor 13, thence through the body 31 to the conductor 14, and from the latter through the terminal 19 to the load L which, in the illustrative case, comprises a filament *f* of an incandescent lamp, thereby providing a resistive load, but it will be understood that the load could be either resistive or inductive.

If the battery B has a voltage of 14 volts, the voltage drop across the conductors 13 and 14 will diminish substantially linearly as the body 31 is compressed inasmuch as the particles contained in the body are subjected to the compressive force. When the body 31 has been compressed an amount corresponding to the difference in thickness between the body 31 and 32 further movement of the conductor 13 toward the conductor 14 will effect compression of both of the bodied 31 and 32. Since the resistance of the body 32 is substantially less that that of the body 31, the establishment of a conductive path between the conductors 13 and 14 via the body 32 will cause the body 31 to be short circuited or by-passed. The voltage drop between the conductors 13 and 14 thus will correspond to the voltage drop across the conductive body 32. If the conductive particles of the body 32 are silver, or silver-coated copper particles, the resistance of the body 32 will be substantially constant and will correspond substantially to the resistance of a silver or silver-coated conductor.

The utilization of the two-part switching member 30 enables full voltage to be applied to the load L in two stages, the first of which has a variable resistance and the second of which has a substantially constant resistance. As a consequence, the inrush current to which the load L is subjected is substantially suppressed.

When the actuator 7 moves from the position shown in FIG. 2 toward the position shown in FIG. 3, the conductor 13 moves away from the conductor 14, thereby relieving the compressive force on the member 30. Due to the difference in thickness between the bodies 31 and 32, the body 32 is fully decompressed while the body 31 still is subjected to compression. As a consequence, the conductive path through the body 30 is transferred from the body 32 to the body 31 and the resistance of the body 31 increases as it is decompressed. In this manner the peak voltage transient associated with the opening of an inductive load circuit is substantially suppressed.

The rapidity of compression and decompression of the member 30 depends upon the speed of movement of the actuator 7 and upon the length and inclination of the surfaces 26 of the cams 25. The rate at which the member 30 is compressed and decompressed may vary within wide limits, but care should be taken to avoid maintaining the current path through the resistive body 31 to such an extent that heat generated by the electrical resistance is detrimental to the silicone rubber.

Figure 8:
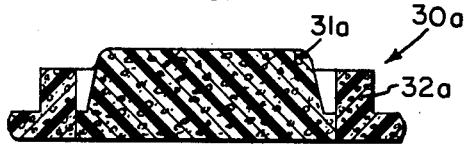
FIG. 8 is a view similar to FIG. 6, but illustrating a modification of the switching member.

To assist in the dissipation of whatever heat may be generated in the body 31, the latter preferably encircles the more conductive body 32. Such an arrangement is not essential, however. If desired, a switching member 30*a* (see FIG. 8) may be constructed in such manner that a variable resistance body 31*a* is encircled by a more conductive body 32*a*, the bodies 31*a* and 32*a* corresponding in construction to the bodies 31 and 32, respectively, with the exception that the body 31*a* is thicker than the body 32*a* so as to be compressed prior to the body 32*a* and to be decompressed following decomposition of the body 32*a*.

Although the disclosed switching members 30 and 30*a* incorporate only two discrete bodies, it will be understood that a greater number of discrete bodies may be included in a single switching member. In such a construction each body would contain particles having conductive properties different from those of the other bodies and the thickness of each more resistive body would be greater than that of a less resistive body.

Figure 9:
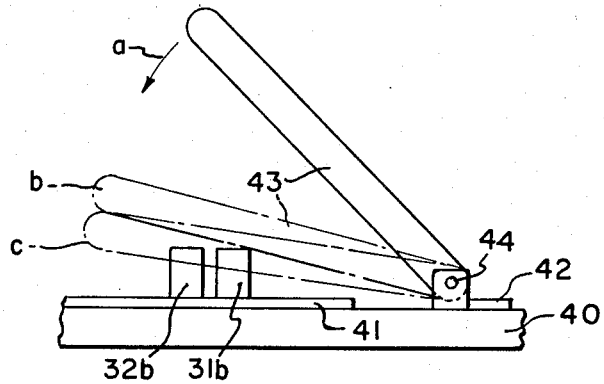
FIG. 9 is a side elevational view of switching apparatus incorporating switch members according to another embodiment of the invention.

It is not essential that the discrete bodies of a multistage switching member be concentric. As is indicated in FIG. 9, an insulating base 40 supports a pair of spaced conductors 41 and 42 adapted to be bridged by a blade 43 swingable about a pivot 44. Mounted side by side on the conductor 41 is a pair of bodies 31*b* and 32*b* corresponding in construction to the bodies 31 and 32, respectively, except for their configuration. The variable resistance body 31*b* is located in a position such that movement of the blade in the direction of the arrow *a* from the full line position to the dotted line position *b* effects compression of the body 31*b* and establishment of a variable resistance path between the conductors 41 and 42 via the blade 43 and the body 31*b*. Further movement of the blade in the direction of the arrow *a* to the dotted line position *c* will effect compression of the more conductive body 32*b*, whereupon the conductive path between the conductors 41 and 42 is via the blade 43 and the body 32*b*. The effect of this arrangement is the same as that which has been described earlier.

Tests of switching members constructed in accordance with the invention have demonstrated remarkable uniformity of the electrical characteristics of such switching members. For example, a construction corresponding to the member 30 was subjected to several hundred thousand on-off cycles with virtually no variation in the voltage drop across the member when the more conductive body 32 was conductive.

The disclosed embodiments are representative of presently preferred forms of the invention but are intended to be illustrative rather than definitive thereof. The invention is defined in the claims.

I claim:

1. An electrical switching device comprising a first body composed of resiliently compressible, non-conductive material containing electrically conductive material having a resistance which varies inversely according to the compression of said first body; and a second body composed of resiliently compressible, non-conductive material containing electrically conductive particles having a substantially uniform resistance lower than that of said conductive material, one of said bodies having an opening extending therethrough and in which the other of said bodies is accommodated.

2. A switch according to claim 1 wherein said one of said bodies is said first body.

3. A switch according to claim 1 wherein said one of said bodies is said second body.

4. A switch according to claim 1 wherein said first and second bodies are of different thickness.

5. A device according to claim 4 wherein said first body is thicker than said second body.

6. A switch according to claim 1 wherein said first body is non-conductive in the absence of compressive force being applied thereto.

7. A switch according to claim 1 wherein said second body is non-conductive in the absence of conductive force being applied thereto.

8. A switch according to claim 1 wherein said second body is conductive in the absence of conductive force being applied thereto.

9. A switch according to claim 1 wherein one of said bodies is non-conductive in the absence of conductive force being applied thereto and the other of said bodies is conductive in the absence of compressive force being applied thereto.

10. A switch according to claim 1 wherein neither of said bodies is conductive in the absence of compressive force being applied thereto.

* * * * *

UNITED STATES PATENT AND TRADEMARK OFFICE

CERTIFICATE OF CORRECTION

PATENT NO. : 3,974,470

DATED : August 10, 1976

INVENTOR(S) : Gideon A. DuRocher

It is certified that error appears in the above-identified patent and that said Letters Patent are hereby corrected as shown below:

Column 1, line 12, change "a" to --an--.

Column 1, line 53, change "in" to --of--.

Column 2, line 14, change "." to --;--.

Column 5, line 3, change "bodied" to --bodies--.

Column 5, line 55, change "decomposition" to --decompression--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*